US010952304B2

(12) United States Patent
Lan et al.

(10) Patent No.: US 10,952,304 B2
(45) Date of Patent: Mar. 16, 2021

(54) FOCUS PLUGGABLE INTERFACE CONTROL DEVICE

(71) Applicant: Shenzhen Guanke Technologies Co., Ltd, Shenzhen (CN)

(72) Inventors: Qing Lan, Shenzhen (CN); Xuren Qiu, Shenzhen (CN); Ligen Liu, Shenzhen (CN); Shoubao Chen, Shenzhen (CN)

(73) Assignee: Shenzhen Guanke Technologies Co., Ltd, Shenzhen (CN)

( * ) Notice: Subject to any disclaimer, the term of this patent is extended or adjusted under 35 U.S.C. 154(b) by 0 days.

(21) Appl. No.: 16/233,098

(22) Filed: Dec. 27, 2018

(65) Prior Publication Data

US 2020/0187320 A1 Jun. 11, 2020

(30) Foreign Application Priority Data

Dec. 7, 2018 (CN) ..... 201811494458.1

(51) Int. Cl.
*H05B 47/175* (2020.01)
*H05B 39/02* (2006.01)
*H05B 39/04* (2006.01)

(52) U.S. Cl.
CPC ..... *H05B 47/175* (2020.01); *H05B 39/02* (2013.01); *H05B 39/04* (2013.01)

(58) Field of Classification Search
CPC ..... H05B 37/0218; H05B 37/0245; H05B 37/0254; H05B 37/0281; H05B 37/0272; H05B 37/0227; H05B 47/175; H05B 39/02; H05B 39/04
See application file for complete search history.

(56) References Cited

U.S. PATENT DOCUMENTS 7,270,441 B2 * 9/2007 Fiene ..... F21V 23/026 336/107
9,538,612 B1 * 1/2017 Reed ..... H05B 47/10
9,924,582 B2 * 3/2018 Vendetti ..... H05B 45/00
10,327,311 B2 * 6/2019 Altamura ..... H05B 45/20
10,334,684 B2 * 6/2019 Polychronakis ..... G06K 9/4661
2003/0222588 A1 * 12/2003 Myron ..... H05B 47/105 315/159
2008/0265797 A1 * 10/2008 Van Doorn ..... G03B 21/206 315/292
2009/0180271 A1 * 7/2009 Jachmann ..... F21L 4/085 362/20

(Continued)

*Primary Examiner* — Amy Cohen Johnson
*Assistant Examiner* — Syed M Kaiser
(74) *Attorney, Agent, or Firm* — Maier & Maier, PLLC

(57) ABSTRACT

A focus pluggable interface control device includes a sensor, a lens covered on the periphery of the sensor and a mounting plug electrically connected to external lamps. Optical signals passing through the lens to be focused is transmitted to the sensor. The lens is configured to collect control information of light types transmitted to the sensor in order to increase sensitivity of the sensor to receive the control information and response speed of the control information, and also expand sensing range of the sensor so as to improve user's experience. The sensor is electrically connected to the external lamp via the mounting plug so that the focus pluggable interface control device can be conveniently replaced, disassembled or installed without needing additional wires, thereby the cost of replacing the control device can be reduced.

6 Claims, 2 Drawing Sheets

(56) References Cited

U.S. PATENT DOCUMENTS

| | | | | |
|---|---|---|---|---|
| 2010/0296285 | A1* | 11/2010 | Chemel | F21V 21/00 362/235 |
| 2011/0251751 | A1* | 10/2011 | Knight | G07C 5/085 701/31.4 |
| 2012/0007507 | A1* | 1/2012 | Niemann | G01D 21/02 315/82 |
| 2013/0293112 | A1* | 11/2013 | Reed | H05B 45/20 315/131 |
| 2013/0342131 | A1* | 12/2013 | Recker | F21S 9/02 315/292 |
| 2014/0163664 | A1* | 6/2014 | Goldsmith | A61B 17/00491 623/1.11 |
| 2015/0084515 | A1* | 3/2015 | Altamura | H05B 47/105 315/131 |
| 2015/0176831 | A1* | 6/2015 | Zhang | F21S 8/085 362/294 |
| 2015/0211701 | A1* | 7/2015 | Chien | F21S 8/035 362/644 |
| 2016/0330825 | A1* | 11/2016 | Recker | H05B 37/0272 |
| 2017/0105272 | A1* | 4/2017 | Johnson | H05B 47/175 |
| 2018/0077779 | A1* | 3/2018 | Johnson | H05B 47/11 |
| 2018/0228557 | A1* | 8/2018 | Darisse | A61B 1/00149 |
| 2018/0332204 | A1* | 11/2018 | Chien | F21V 21/30 |
| 2019/0120450 | A1* | 4/2019 | Chien | F21S 4/28 |

* cited by examiner

FOCUS PLUGGABLE INTERFACE CONTROL DEVICE

CROSS-REFERENCE TO RELATED APPLICATION

This application claims the priority benefit of CN application serial no. 201811494458.1, filed Dec. 7, 2018. The entirety of the above-mentioned patent application is hereby incorporated by reference herein and made a part of specification.

BACKGROUND

1. Technical Field

The present disclosure generally relates to control devices field, and especially relates to a focus pluggable interface control device.

2. Description of Related Art

A conventional lamp generally includes a lamp holder, a power supply and a lamp body. The external lamp holder is connected with an external input power supply and then an external switch is controlled the external lamp body to light or extinguish via the power supply, or the external lamp holder is directly controlled the external lamp to light and extinguish. Such control mode above mentioned is relatively simple. At the same time, because use conditions of a lamp switch are limited, the external lamp control mode can't be changed if its control circuit is separately rearranged. And, the conventional lamp with dimming light brightness and setting light duration is generally integrated a control module with the external lamp, but rather than being detached therebetween. Thus, the control mode of the external lamp is difficult to be adjusted after the external lamp is out of the factory, which includes the replacement between different types of control modules, or between different versions of control modules with the same type. As a result, when the control module of the external lamp is upgraded or the control mode is updated, the external lamp needs to be replaced as a whole, or even its installation circuits should be rearranged, which causing inconvenience and high cost.

Therefore, in order to solve the problems above mentioned, a pluggable control device is designed as a switch for controlling the external lamp to light or extinguish. However, such conventional pluggable control device has disadvantages below: Firstly, when density of induction information is weak, the pluggable control device can't receive enough induction information so that it can't control the external lamp to be turned on or turned off via an induction way, even the induction effect can be delayed due to a low sensitivity of the induction information. Secondly, the pluggable control device can't meet user's need due to its narrow sensing range.

SUMMARY

The technical problems to be solved: in view of the shortcomings of the related art, the present disclosure relates to a focus pluggable interface control device which can increase its sensing range and sensitivity through its lens and be conveniently replaced, disassembled or installed without needing additional wires.

The technical solution adopted for solving technical problems of the present disclosure is:

a focus pluggable interface control device electrically connected to an external lamp for controlling the external lamp includes a sensor, a lens covered on the sensor, and a mounting plug electrically connected to the sensor and configured to mount the focus pluggable interface control device to the external lamp. The sensor is configured to collect control information via the lens, and then electrically connected to the external lamp for controlling the external lamp to light or extinguish.

Wherein the mounting plug can be selected from one of a RJ45 plug, a USB plug and an earphone plug.

Wherein the focus pluggable interface control device further includes a housing receiving the sensor therein and tightly fixed with the lens.

Wherein the focus pluggable interface control device further includes a mounting plate engaged with the sensor and the mounting plug, respectively.

Wherein the mounting plate includes a fixing portion for jamming the sensor so that the sensor is tightly fixed with the mounting plate when the sensor is installed on the mounting plate.

Wherein the sensor includes an adjusting portion configured to adjust output signals of the sensor.

Wherein the focus pluggable interface control device further includes an adjusting member inserted into the adjusting portion, the adjusting portion is rotated by adjusting the adjusting member so that the output signals of the sensor can be changed.

Wherein the mounting plug includes a wire, and the sensor includes a weld connected to the wire so that the sensor is electrically connected to the mounting plug.

The present disclosure provides the advantages as below.

Firstly, the structure of the present disclosure that the lens is configured to collect control information of light types transmitted to the sensor in order to increase sensitivity of the sensor to receive the control information and response speed of the control information, and also expand sensing range of the sensor so as to improve user's experience.

Secondly, the structure of the present disclosure that the sensor is electrically connected to the external lamp via the mounting plug so that the focus pluggable interface control device can be conveniently replaced, disassembled or installed without needing additional wires, thereby the cost of replacing the control device can be reduced.

Thirdly, the structure of the present disclosure can adjust energy-saving parameter and proportion of the external lamp and compromise energy-saving level and brightness of the external lamp, thereby a better experience can be obtained.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

Figure 1:
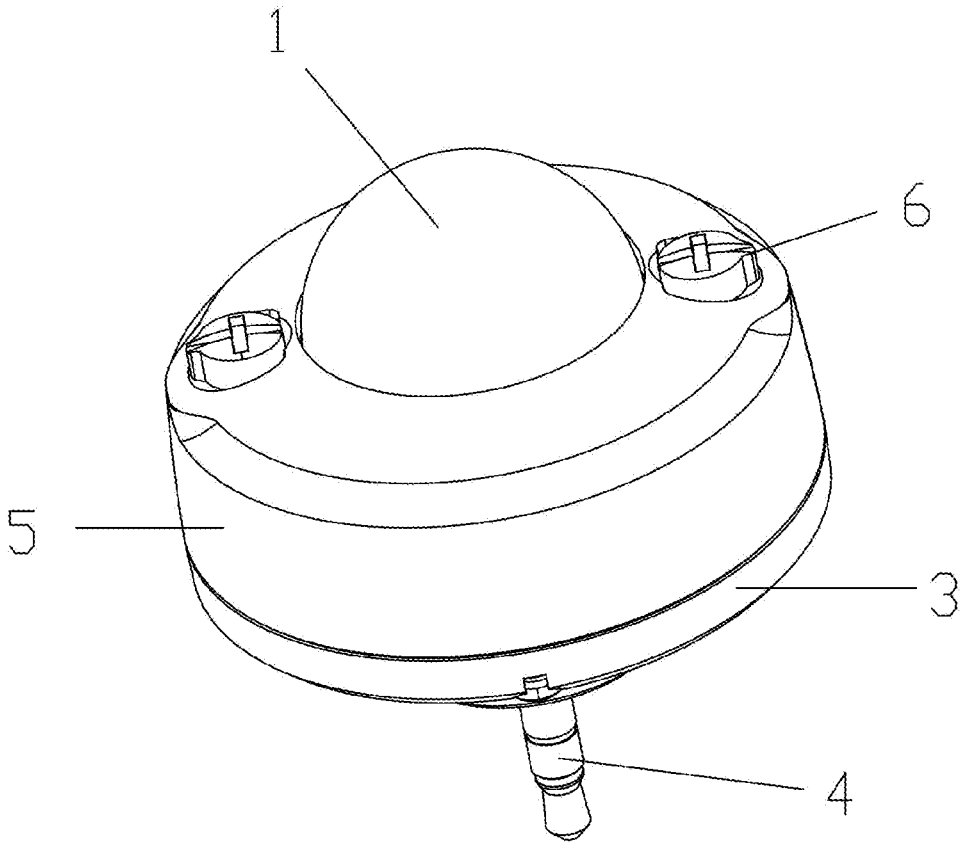
FIG. 1 is a schematic view of the focus pluggable interface control device in accordance with an exemplary embodiment.

The disclosure is illustrated by way of example and not by way of limitation in the figures of the accompanying drawings, in which like reference numerals indicate similar elements.

Figure 2:
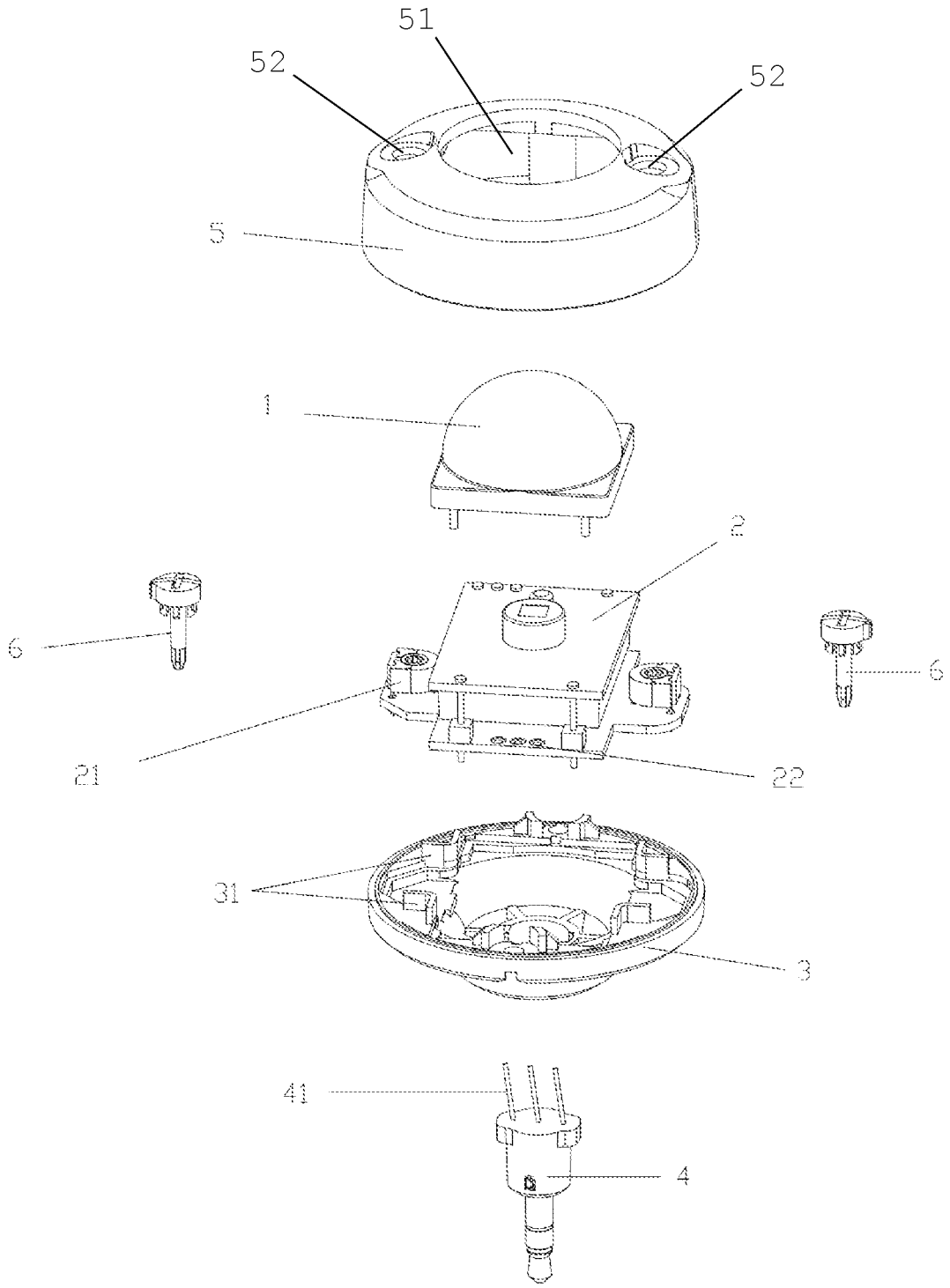
FIG. 2 is an exploded, schematic view of the focus pluggable interface control device of FIG. 1.

Referring to FIG. 1 and FIG. 2, a focus pluggable interface control device electrically connected to an external lamp for controlling the external lamp to light or extinguish in accordance with an exemplary embodiment is provided. The focus pluggable interface control device includes a sensor 2, a lens 1 covered on the sensor 2, and a mounting plug 4 electrically connected to the sensor 2 and configured to mount the focus pluggable interface control device on the external lamp. The sensor 2 is configured to collect control information via the lens 1, and then electrically connected to the external lamp for controlling the external lamp to light or extinguish.

The sensor 2 is configured to collect control information via the lens 1, and then electrically connected to the external lamp for controlling the external lamp to light or extinguish.

The lens 1 of the focus pluggable interface control device is configured to collect control information of light types (such as infrared information, microwave information or light intensity) transmitted to the sensor 2 in order to increase sensitivity of the sensor 2 to receive the control information and response speed of the control information, and also expand sensing range of the sensor 2 so as to improve user's experience. The sensor 2 can be selected from one of an infrared sensor, a microwave sensor and a photosensitive sensor.

In an exemplary embodiment of the present disclosure, the sensor 2 is electrically connected to the external lamp via the mounting plug 4 so that the sensor 2 can control the external lamp after it received control information. In this way, the focus pluggable interface control device can be conveniently replaced, disassembled or installed without needing additional wires, thereby the cost of replacing the control device can be reduced.

The mounting plug 4 can be selected from one of a RJ45 plug, a USB plug and an earphone plug. The lens 1 can be a Fresnel lens.

In an exemplary embodiment of the present disclosure, the mounting plug 4 can be selected from one of a RJ45 plug, a USB plug and an earphone plug so that the focus pluggable interface control device can be adapted to match with various bases. Of course, in other exemplary embodiments of the present disclosure, a similar pluggable effect achieved by other pluggable ways should also be claimed within the principles of the present disclosure.

When the focus pluggable interface control device is plugged into the external lamp, the sensor 2 is electrically connected to circuits of the external lamp via the mounting plug 4 for controlling the external lamp to be opened, or be closed or be adjusted.

In an exemplary embodiment of the present disclosure, the lens 1 can be a Fresnel lens. Fresnel lenses are thinner and have lower light attenuation than normal convex lenses. Thus, when the Fresnel lens collects the control information, its spotlight corner does not become dimming or blurring, thereby a good spotlight effect can be obtained.

The focus pluggable interface control device further includes a housing 5 for receiving the sensor 2 therein, and a mounting plate 3 engaged with the sensor 2 and the mounting plug 4, respectively. The lens 1 is tightly fixed with the housing 5.

In an exemplary embodiment of the present disclosure, the housing 5 is configured to cover on internal circuits of the focus pluggable interface control device, and the mounting plate 3 is tightly fixed with the sensor 2. After installing the housing 5 on the mounting plate 3, the internal circuits are received between the mounting plate 3 and the housing 5 so that the internal circuits are waterproof and dustproof therein.

In an exemplary embodiment of the present disclosure, when the housing 5 is fixed on the mounting plate 3, the housing 5 is simultaneously fixed with the lens 1 covered on the periphery of the sensor 2. In this way, the housing 5 not only wraps the lens 1 to prevent the lens 1 from sliding off, but also a bottom end of the lens 1 is abutted against an inner side of the housing 5, so that the lens 1 is fixed between the sensor 2 and the housing 5 and extends through a first mounting hole 51.

In an exemplary embodiment of the present disclosure, the mounting plug 4 passes through the mounting plate 3 and is fixed in the center of the bottom of the mounting plate 3. One part of the mounting plug 4 located outside the mounting plate 3 is used for mounting on the external lamp, and the other part of the mounting plug 4 located inside the mounting plate 3 is provided for fixing and electrically connecting with the sensor 2.

The mounting plate 3 includes a fixing portion 31 for jamming the sensor 2 so that the sensor 2 is tightly fixed with the mounting plate 3 when the sensor 2 is installed on the mounting plate 3.

In an exemplary embodiment of the present disclosure, the fixing portion 31 is configured to fix the sensor 2 on the mounting plate 3 to prevent the sensor 2 from being damaged which is caused by movement of the sensor 2 in the mounting plate 3 when the focus pluggable interface control device is operated. At the same time, the housing 5 is mounted on the mounting plate 3 and also pressed on the sensor 2 to further fix the sensor 2.

The sensor 2 includes an adjusting portion 21 configured to adjust output signals of the sensor 2. The focus pluggable interface control device further includes an adjusting member 6 inserted into the adjusting portion 21 and extending through a second mounting hole 52. The adjusting portion 21 is rotated by adjusting the adjusting member 6 so that the output signals of the sensor 2 can be changed.

In an exemplary embodiment of the present disclosure, in order to further expand the sensing range, the focus pluggable interface control device can further include the adjusting member 6 and the adjusting portion 21 connected to the adjusting member 6. After the mounting plug 4 is mounted on the external lamp, the adjusting portion 21 can be set as a resistance element or a time-controlled switch element according to user's usage condition, so that the brightness and light duration of the external lamp can be controlled by rotating the adjusting member 6 to further optimize the control mode of the sensor 2 to the external lamp and expand usage range of the focus pluggable interface control device.

In an exemplary embodiment of the present disclosure, when the external lamp is installed, the adjusting member 6 and the adjusting portion 21 are adjusted to adjust energy-saving parameter and proportion of the external lamp and compromise energy-saving level and brightness of the external lamp, thereby a better experience can be obtained.

The mounting plug 4 includes a wire 41, and the sensor 2 includes a weld 22 connected to the wire 41 so that the sensor 2 is electrically connected to the mounting plug 4.

In an exemplary embodiment of the present disclosure, a connection between the mounting plug 4 and the sensor 2 via the wire 41 is simple and stable, thereby the production cost of the focus pluggable interface control device can be further minimized.

Although the features and elements of the present disclosure are described as embodiments in particular combinations, each feature or element can be used aloe or in other various combinations within the principles of the present disclosure to the full extent indicated by the broad general meaning of the terms in which the appended claims are expressed.

What is claimed is:

1. A focus pluggable interface control device comprising:

a lens which covers a sensor; a mounting plate; a mounting plug; and a housing, wherein the sensor collects control information which has passed through the lens, wherein the mounting plate, by way of at least one locating member, is fixed to the sensor by jamming the sensor against the at least one locating member and thereby the sensor is also fixed to the mounting plug, wherein the mounting plug is electrically connected to the sensor, wherein the mounting plug is provided to mount the focus pluggable interface control device onto the external lamp and to create an electrical connection between the sensor and the external lamp so that the focus pluggable interface control device may control the external lamp, wherein the housing is connected to the mounting plate, thereby securing a bottom portion of the lens, and the housing is provided with a first mounting hole through which the lens extends, wherein the housing is further provided with at least one second mounting hole, wherein a rotatable adjusting member extends through each of the at least one second mounting holes to connect with a corresponding adjusting portion provided on the sensor and the corresponding adjusting portion is formed as an adjustable resistance element, wherein an output signal of the sensor for a given control information is adjustable by rotating the rotatable adjusting member.

2. The focus pluggable interface control device as claimed in claim 1, wherein the mounting plug is provided centrally in a bottom of the mounting plate and extends through the mounting plate, wherein a portion of the mounting plug external to an enclosure created by the mounting plate, the lens, and the housing is used to connect the focus pluggable interface control device to the external lamp.

3. The focus pluggable interface control device as claimed in claim 1, wherein a portion of the mounting plug external to an enclosure created by the mounting plate and the housing is selected from one of an RJ45 plug, a USB plug, and an earphone or headphone plug.

4. The focus pluggable interface control device as claimed in claim 1, wherein, by adjusting the output signal of the sensor, the rotatable adjusting members adjust a brightness and/or a light duration of the external lamp.

5. The focus pluggable interface control device as claimed in claim 1, wherein the mounting plug is further secured to the sensor via a weld.

6. The focus pluggable interface control device as claimed in claim 1, wherein the first mounting hole and the at least one second mounting hole are disposed adjacent to one another.

* * * * *